United States Patent [19]

Moser

[11] Patent Number: 4,729,681

[45] Date of Patent: Mar. 8, 1988

[54] DOCUMENT PROCESSING DEVICE FOR SINGLE DOCUMENTS SEPARABLE FROM A CROSS-PERFORATED CONTINUOUS FORM WEB

[75] Inventor: Erich Moser, Taufkirchen, Fed. Rep. of Germany

[73] Assignee: Siemens Aktiengesellschaft, Berlin and Munich, Fed. Rep. of Germany

[21] Appl. No.: 820,804

[22] Filed: Jan. 22, 1986

[30] Foreign Application Priority Data

Jan. 25, 1985 [DE] Fed. Rep. of Germany ..... 3502529

[51] Int. Cl.[4] ..... B41J 11/34

[52] U.S. Cl. ..... 400/613.2; 400/616.2; 400/693

[58] Field of Search ..... 235/379, 380, 382; 400/693, 611, 613, 613.1–613.3, 616, 618–619, 621, 642, 645.4, 616.2; 346/22; 232/7, 12, 43.1; 109/24.1, 25; 221/25; 194/350, 353; 271/297, 302–303; 225/100, 106

[56] References Cited

U.S. PATENT DOCUMENTS

| | | | |
|---|---|---|---|
| 3,656,602 | 4/1972 | Konkel et al. | 400/616 |
| 3,937,925 | 2/1976 | Boothroyd | 346/22 X |
| 4,348,125 | 9/1982 | Fujiwara et al. | 400/645.1 |
| 4,463,939 | 8/1984 | Watanabe | 235/379 X |
| 4,467,331 | 8/1984 | Tsutsumi et al. | 346/22 |
| 4,510,345 | 4/1985 | Costa et al. | 400/693 X |
| 4,588,286 | 5/1986 | Stockburger et al. | 235/382 X |
| 4,605,145 | 8/1986 | Engelhardt et al. | 226/74 |
| 4,606,534 | 8/1986 | Gombault | 225/106 |
| 4,615,280 | 10/1986 | Shoop et al. | 109/24.1 |
| 4,623,081 | 11/1986 | Hain et al. | 225/106 X |

FOREIGN PATENT DOCUMENTS

| | | | |
|---|---|---|---|
| 0127144 | 12/1984 | European Pat. Off. . | |
| 3333537 | 3/1984 | Fed. Rep. of Germany . | |
| 3522022 | 1/1986 | Fed. Rep. of Germany | 400/621 |
| 1402910 | 5/1965 | France . | |
| 59-54587 | 3/1984 | Japan . | |

*Primary Examiner*—Edgar S. Burr
*Assistant Examiner*—Joseph McCarthy
*Attorney, Agent, or Firm*—Hill, Van Santen, Steadman & Simpson

[57] ABSTRACT

A document processing device is provided which is front accessible for use and service and is composed of a paper supply space for cross-perforated continuous-form paper webs, a printing mechanism including a paper feed device, platen and print head, a separator device for producing single documents and an output and/or deposit stacker for single documents. The paper feed device and the paper guidance elements proceeding along the paper web are arranged such that the paper supply space closable by means of a removable housing cover as well as the output and/or deposit stacker are accessible from the front side. The paper supply space and the printing mechanism are located in a lower cabinet rack part whereas the paper guidance elements and devices including the output and/or deposit stacker which follow downstream of the printing mechanism are located in an upper cabinet rack part pivotably secured to the lower cabinet rack part.

8 Claims, 1 Drawing Figure

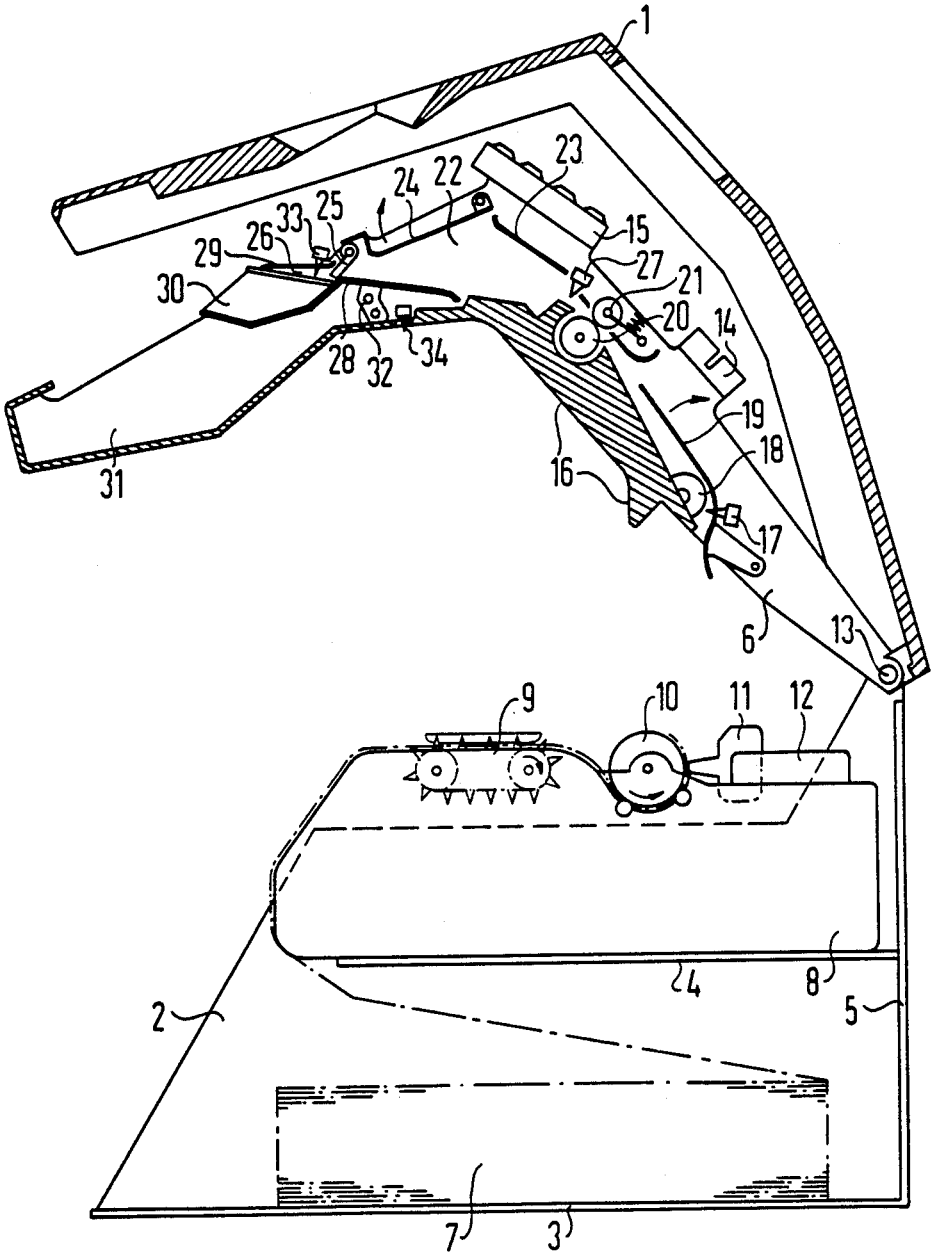
1
23
24
22
25
33
26
29
30
15
27
21
20
14
28
32
34
19
18
16
17
31
6
13
9
10
11
12
4
8
5
2
7
3

DOCUMENT PROCESSING DEVICE FOR SINGLE DOCUMENTS SEPARABLE FROM A CROSS-PERFORATED CONTINUOUS FORM WEB

BACKGROUND OF THE INVENTION

1. Field of the Invention

The invention relates to a document processing device which includes a paper supply space for cross-perforated continuous form paper webs, a printing mechanism including a paper feed mechanism, platen and printing head, separator device for producing single documents and an output and/or deposit stacker for the single documents.

2. Description of the Prior Art

Such document processing devices are employed, for example, in banks and savings institutions as so-called statement of account printers. They are self-service devices which provide the respective user, insofar as he possesses an authorization card, for example a magnetic strip-coded checking card, with the opportunity to have the most recent account transactions and, thus, the current value on account printed out on one or more documents. These devices are to be installed in the banking hall flush against the wall insofar as possible and are to be secured there, the consequence thereof, however, being that they are then no longer accessible without further ado, from the back.

SUMMARY OF THE INVENTION

An object of the present invention is to provide a document processing device of the type described above such that not only operation by customers but also the maintenance of the device, for example replenishing paper, insertion of the paper fed into the feed mechanism, replacing the inked ribbon or the ink cartridge as well as the elimination of a disruption in service caused by a paper jam can be performed from the front of the device.

This object is achieved in accord with the invention by providing that the paper feed mechanism and paper guidance elements extending along the paper web are arranged such that the paper supply space closable by means of a removable housing cover as well as the output or deposit stacker are accessible from the front side, in that the paper supply space and the printing mechanism are situated in a lower part of a cabinet rack, and the paper guidance elements and devices including the output and deposit stackers, following downstream of the printing mechanism are situated in an upper cabinet rack pivotably secured to the lower cabinet rack part.

BRIEF DESCRIPTION OF THE DRAWINGS

An exemplary embodiment of the invention is illustrated schematically in cross-section in the drawing.

DESCRIPTION OF THE PREFERRED EMBODIMENTS

The device shown in section in the FIGURE is composed of a cabinet rack having a plurality of functional modules and a housing. The only part of the housing which is visible is the housing cover 1, whereas the back wall and two side walls have not been shown for reasons of clarity. The cabinet rack is designed bi-partite and is composed of a lower cabinet rack part 2 with floor 3, intermediate floor 4, two side walls (not shown) and a cabinet rack back wall 5 as well as of a pivotable upper cabinet rack part 6. A paper supply space for a continuous form stack 7 is provided between the floor 3 and the intermediate floor 4. From this paper supply space, which is open toward the front, the paper web proceeds to a printing mechanism 8 secured on the intermediate floor 4. This printing mechanism 8 is essentially composed of a feed means, for example of paper tractors 9 for the paper web provided with marginal perforation, of a platen 10, of a print head 11 and of an inked ribbon cassette or ink cartridge 12, as well as appertaining drives and controls. The upper part 6 of the cabinet rack which can be pivoted up via a pivoting axis 13 at the back wall 5 of the cabinet rack contains the paper processing stations such as separator device, collecting stacker, output stacker and deposit stacker, which follow the printing mechanism 8. Also secured to the upper side of the upper part 6 of the cabinet rack are a badge reader 14 for a customer-associated authorization badge, checking card or the like, a keyboard 15 for inputing a customer-associated code number, as well as a display (not shown).

Such a device which is employable, for example, as a statement of account printer offers the advantage, in view of maintenance, that the paper supply space, the paper guidance for the printing mechanism 8 and the feeder mechanism comprising the paper tractors, 9 are accessible from the front of the device. The paper web coming from the paper supply space first proceeds via the horizontally applied paper tractors 9 which enable a user-friendly paper insertion, proceeding in the direction toward the back wall 5 of the cabinet rack and, after deflection by the platen 10, then proceeding in the opposite direction back to an output stacker 26 at the front side of the device. The upper part of the paper guidance in the region of the paper tractors 9 and of the let-in channel into the platen 10 is composed of guide profiles 16 provided at the underside of the pivotable upper part 6 of the cabinet rack. The paper web to be loaded can be comfortably placed on the paper tractors 9 from the top in this way without having to be inserted through any guide slots whatsoever.

For operation of the device, the upper part 6 of the cabinet rack and the housing cover 1, secured to the same pivoting axis 13, are pivoted down and locked to the lower part 2 of the cabinet rack. The function of the device can be checked by hinging the housing cover 1 up, this being held by a latch mechanism, and a paper jam which may be present can be removed. The upper part 6 of the cabinet rack must also be pivoted up for inserting the paper and for changing the inked ribbon. After releasing an interlock, this occurs with the assistance of a compression spring, for example a pneumatic spring (not shown) which is chucked between the lower part 2 of the cabinet rack and the upper part 6 of the cabinet rack.

As soon as a continuous form stack 7 has been placed in the paper supply space and the start of the paper with the marginal perforation has been placed into the paper tractors 9, the upper part 6 of the cabinet rack is again hinged down against the pressure of the pneumatic spring and the housing cover 1 is also hinged down. The device can now be started, whereby the paper is automatically supplied to the platen 10 and is printed by means of the print head 11 and inked ribbon. A light barrier or sensor 17 provided following the platen 10 senses the leading edge of the paper and thus serves for automatic adjustment of the printout format. In terms of drive, the platen 10 is coupled to the paper feeder mechanism and pushes the paper to a pair of burst rollers 20, 21 via a separator device 18 with an appertaining paper guide 19 provided in the upper part 6 of the cabinet rack. The distance between separator device 18 and pair of burst rollers 20, 21 corresponds to the length of the document or form which is prescribed by the respective cross-perforations in the continuous-form paper web. The circumferential speed of the pair of burst rollers 20, 21 is also selected higher than that of the platen 10 so that a tractive force is exerted on the paper web as soon as it proceeds between the pair of burst rollers 20, 21, being exerted as a consequence of the counter-hold by the platen 10 and the paper tractors 9. Promoted by the separator device 18, this tractive force effects a tearing of the paper web at the cross-perforation. A double cone is provided as the separator device 18 or tearing aid, the largest diameter of this double cone projecting into the center of the paper web and, consequently, parting the perforation toward both sides proceeding from the middle.

The single document which has arisen in this fashion is now transported by the pair of burst rollers 20, 21 into a collecting stacker 22. One of two upper paper guidance elements 23, 24 provided in the collecting stacker 22 can be hinged up and thus provides the access for removing a potential paper jam. Two retention fingers 25 are provided in the collecting stacker 22, these preventing the individual documents from sliding out into the following output stacker 26 until all single documents, for example statements of account, intended for the respective user have been printed and are stacked in the collecting stacker 22. A light barrier 27 monitors the transport by the burst rollers 20, 21 and the parting or separating of the documents forms. After the retention fingers 25 have been pivoted up, all documents, for example statements of account, present in the collecting stacker 22 slide on a support surface 28 seated as a rocker, sliding into the output stacker 26 and are then prevented from falling out by two brake springs 29. For removal by the user's hand, the rocker is provided with a recessed grip 30 and the output stacker is enlarged with a housing clearance. The latter also enables visual control of the output stacker 26.

Upon removal, the documents or statements of account are pulled manually from the output stacker 26 against the resistance of the brake springs 29. When the documents are not removed in due time, further transport into a deposit stacker 31 which is not accessible from the outside ensues for reasons of data protection. To this end, the rocker is pivoted around a rotational axis 32 via a bent lever mechanism, whereby the documents fall into the deposit stacker 31 situated therebelow on the basis of the force of gravity after they have been released by the brake springs 29. The maintenance personnel can remove them from there after opening the housing cover 1.

The slide-out of the documents into the output stacker 26 after the opening of the retention fingers 25, the removal of the documents by the customer and, finally, whether the output stacker is free of paper after the rocker has pivoted away and returned into its initial position are monitored via a light barrier 33 provided in the output stacker 26.

The pivot of the rocker is blocked by the bent lever which is elongated in the output position. Pivoting the rocker back from the outside and access into the deposit stacker are thus prevented. The bent lever is held in an elongated position by means of a recuperating spring and a detent secured to the upper part 6 of the cabinet rack. Finally, it is pivoted back into its initial position with the assistance of an electromagnet. A light barrier 34 provided at the upper part 6 of the cabinet rack below the rocker is directed to the paper guidance immediately in front of the paper tractors 9 and reports a potential end of the paper web to the control of the device.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A document processing device including a paper supply space for cross-perforated continuous-form paper webs, a printing mechanism including a paper feed mechanism, platen and printing head, a separator device for producing single documents, paper guidance elements, an output stacker and a deposit stacker for said single documents and a front side accessible by a user, comprising the improvement of a cabinet rack having a lower rack part, an upper rack part, a back wall and a front with a bottom edge, a housing serving to enclose said upper cabinet rack part and said lower rack part being composed of a back wall with an upper edge, two side walls and a housing cover pivotally secured to said back wall of said cabinet rack and extending down to said bottom front edge of said cabinet rack, said paper feed mechanism and paper guidance elements proceeding along said paper web arranged such that said paper supply space, closed by means of said pivotable housing cover, as well as said output stacker and said deposit stacker are accessible from said front side of the device; said paper supply space and said printing mechanism being situated in said lower part of said cabinet rack; at least some of said paper guidance elements being positioned upstream and at least some positioned downstream of said printing mechanism; said paper guidance elements following downstream of said printing mechanism, as well as said output stacker and said deposit stacker, being situated in said upper cabinet rack part, said upper cabinet rack part being pivotably secured to said lower cabinet rack part and said output stacker being located at said front of said cabinet rack.

2. A document processing device according to claim 1, wherein a housing is provided serving to enclose said upper cabinet rack part and said lower cabinet rack part and is composed of a back wall with an upper edge, two side walls and said housing cover which is pivotably secured to a back wall of said cabinet rack and extending down to a bottom edge of the front side of said cabinet rack.

3. A document processing device according to claim 1, wherein said upper cabinet rack part and said housing cover have a common pivoting axis which proceeds along said upper edge of said back wall of said cabinet rack, whereby the upper cabinet rack part and the housing cover, in their respective closed positions, extend to the front bottom edge of said cabinet rack.

4. A document processing device according to claim 1, wherein said platen of said printing mechanism serve as a deflection element for the paper web proceeding from said lower cabinet rack part into said upper cabinet rack part.

5. A document processing device according to claim 1, wherein upstream of said printing mechanism said paper guidance elements are provided on said upper rack part and said lower rack part and downstream of said printing mechanim said paper guidance elements are provided solely on said upper rack part, whereby upstream of said printing mechanism paper guidance ensues between said lower rack part and said upper rack part and downstream of said printing mechanism paper guidance ensues within said upper rack part.

6. A document processing device according to claim 5, wherein said upstream paper guide elements include upper paper guidance elements provided for paper guidance between said lower cabinet rack part and said upper cabinet rack part, said upper paper guidance elements being formed by guide profiles provided at the underside of the pivotable upper cabinet rack part.

7. A document processing device accessible from a front side for use and service comprising:

a housing enclosing said device including a front housing wall;

an upper and lower cabinet rack part enclosed within said housing;

said upper cabinet rack part and said front housing wall being pivotally attached to said lower cabinet rack part;

a paper supply space provided in said lower cabinet rack part closed by means of said pivotable housing cover and accessible from the front side of the device;

a printing mechanism including a paper feed mechanism, platen and printing head provided in said lower cabinet rack part;

a separator device for producing single documents provided in said upper cabinet rack part;

paper guidance elements being positioned upstream and downstream of said printing mechanism, said downstream guidance elements being provided in said upper rack part;

an output stacker and deposit stacker for single documents provided in said upper rack part and both being accessible from the front of the device;

said front housing wall having an opening therethrough for providing user access to said output stacker.

8. A document processing device according to claim 7, wherein said front housing wall and said upper rack part are both pivotally attached to a rear wall of said lower rack part along a common axis.

* * * * *